US009016215B2

(12) United States Patent
Özyaman

(10) Patent No.: US 9,016,215 B2
(45) Date of Patent: Apr. 28, 2015

(54) SOLID FUEL UNIT WHICH BURNS SOLID FUELS TOGETHER WITH THEIR VOLATILE GASES

(76) Inventor: Senol Faik Özyaman, Çorum (TR)

( * ) Notice: Subject to any disclaimer, the term of this patent is extended or adjusted under 35 U.S.C. 154(b) by 658 days.

(21) Appl. No.: 13/075,448

(22) Filed: Mar. 30, 2011

(65) Prior Publication Data

US 2011/0315056 A1 Dec. 29, 2011

(30) Foreign Application Priority Data

Jun. 29, 2010 (TR) ..... 2010 05272

(51) Int. Cl.

| | |
|---|---|
| ***F23K 3/00*** | (2006.01) |
| ***F23B 10/02*** | (2011.01) |
| ***F23B 30/00*** | (2006.01) |
| ***F23B 40/04*** | (2006.01) |
| ***F23B 80/04*** | (2006.01) |
| ***F23J 1/00*** | (2006.01) |
| ***F23K 3/14*** | (2006.01) |

(52) U.S. Cl.

CPC ..... *F23B 10/02* (2013.01); *F23B 30/00* (2013.01); *F23B 40/04* (2013.01); *F23B 80/04* (2013.01); *F23J 1/00* (2013.01); *F23K 3/14* (2013.01)

(58) Field of Classification Search

CPC ..... F23K 3/00; F23K 3/14

USPC ..... 110/104 R, 275, 276, 292, 293, 267, 287

See application file for complete search history.

(56) References Cited

U.S. PATENT DOCUMENTS

| | | | | | |
|---|---|---|---|---|---|
| 923,404 | A | * | 6/1909 | Burger | 110/276 |
| 1,392,323 | A | | 10/1921 | Goldberg | |
| 2,320,410 | A | * | 6/1943 | Cheasley | 122/374 |
| 2,455,817 | A | * | 12/1948 | Sherman | 110/190 |
| 3,693,812 | A | * | 9/1972 | Mahr et al. | 414/148 |
| 4,540,467 | A | * | 9/1985 | Grube et al. | 162/4 |
| 5,027,719 | A | * | 7/1991 | Chenard | 110/165 R |
| 5,052,311 | A | * | 10/1991 | Kincaid | 126/500 |
| 5,382,291 | A | | 1/1995 | Olioso | |
| 5,507,946 | A | * | 4/1996 | Stearns | 210/202 |

* cited by examiner

*Primary Examiner* — Kenneth Rinehart
*Assistant Examiner* — Gajanan M Prabhu
(74) *Attorney, Agent, or Firm* — Egbert Law Offices, PLLC

(57) ABSTRACT

The invention relates to solid fuel units having a fuel supply chamber wherein the fuel to be sent for combustion to the combustion region found in the body is placed and the feed mechanism carrying the solid fuel found in the chamber forward. It is characterized in that it includes a main burning block having a fuel and air cell connected to the solid fuel supply chamber and air outlet vents formed on the external wall surface. A preventive surface is positioned on the main burning block external wall surface in a way that it would form a closed volume in a certain distance.

11 Claims, 3 Drawing Sheets

SOLID FUEL UNIT WHICH BURNS SOLID FUELS TOGETHER WITH THEIR VOLATILE GASES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a solid fuel burning unit, by which the heated air, hot water, steam, and hot oil demands are met by burning coal, organic fuel, bagasse, nut shell, wood flour, rice stem etc. solid fuels, which are burned in industrial and domestic areas for production or heating purposes.

The present invention relates to a solid fuel burning unit comprising a fuel supply chamber wherein the fuel to be sent for combustion to the combustion region found in the body is placed and the feed mechanism carrying the solid fuel found in the said chamber forward, a main burning block having fuel/air cell connected to the said solid fuel supply chamber and air outlet vents formed on the external wall surface. A preventive surface positioned on the said main burning block external wall surface in a way that it would form a closed volume in a certain distance. At least one fuel discharge outlet provides sending of the fuel, which is transferred to the said main burning block cell, to the external wall surface. At least one push flap is provided, which provides pushing of the solid fuel to the outlet hole via the spiral wings formed as facing each other, and which is connected on the same shaft in a way that it would make rotating motion.

BACKGROUND OF THE INVENTION

Nowadays, there are various types of burning techniques and heat rooms. Various deficiencies are encountered in most of these systems. For example, it is generally seen that volatile gases can not be combusted, required emission standards can not be met, and thus natural gas etc. fuels are preferred in classical burners. In the prior burners, high calorie coal is used due to inefficient combustion. However, its consumption is prohibited because its reserves are quickly exhausted and low calorie coal, which is easy to produce, can not meet the emission standards.

With the affect of the gases discharged from chimneys, flue dust is seen in pipes and halts are required in the facility or system for cleaning fire room pipes. Investment for filtration and dust holder cyclones are required in order to meet the emission standards. When the un-combusted carbon ratio of the ash examination after combustion in the prior combustion techniques (stoker, fluid bed, traveling grate, manual load etc.) is analyzed, they are observed to operate at around a 30-70% efficiency level.

Since excessive fuel load is made in the prior systems, and due to the CO found in the chimney emission, a high amount of losses occur or stack gas losses occur due to burning low amount of coal with high rate of air. In some burner systems, coal thickness is so high in some areas (formation of CO increases due to insufficient air) and so low in other areas (causes excessive air and increase of oxygen amount in the stack gas). Coal is not spread uniformly in the medium where it is combusted, and therefore the stack gas analysis show high oxygen and CO ratios at the same time.

Efficiency of the burner is affected by air amount, uniformity, proportionality, homogeneous spreading, and controllability of the system and these conditions can not be achieved in the prior systems. In many combustion systems, it is seen that the air amount is simply adjusted according to the appearance and way of burning of the coal. Most of the classical burners are picky about fuel. They can combust only certain sizes of fuels and high dust level affects combustion efficiency in the classical burners and also many systems are not convenient for burning dust or they simply can not burn. In coarse coal burners, efficiency is low, since the optimization of spreading of the coal is not uniform and the dust ratio is variable.

In general applications, feed controls are adjusted in a faulty manner and stack gas losses reach very high levels due to excessive air. Systems providing air/fuel control are fitted to large capacity fire rooms and in this way the efficiency of fire rooms attempts to be improved. However, the burning and operation technique of these systems are not efficient enough, they have high costs and their first investment costs are also very high.

At the hotspot (fire rooms) region of the prior systems, water walls, air walls etc. systems are used instead of insulation. This approach cools the fire room and the temperature of the hotspot becomes much lower than the ignition temperature of solid fuels and thus efficient combustion can not occur.

Some applications are encountered in the patent research made about fuel systems. Among these applications, a patent application is found with No. TR2004/01312 and dated Jun. 4, 2004. On the abstract page of this application, these expressions are found: The present invention relates to having barrel-shaped corresponding nozzles at the metal surface facing the fire of coal burning chamber of the coal burning system (stoker), placement of firebricks at the metal surface in a way that they would also close the nozzles, passing of the shaft, which provides coal feed, into the coal burning chamber through a narrow mouth, and thermostatic protection. There are nozzles at the metal surface facing the fire of the coal burning chamber and the metal surface is covered with firebricks. Coal brought to the narrow mouth coal burning chamber by the shaft is heated with the heat given from the nozzles. When the fire room is not active, the thermostat locks the system and prevents air flow.

Another application is No. TR2002/01980, application of which was made to Turkish Patent Institute on Sep. 8, 2002. In this application: the invention is a system formed of reducer, coal chamber, spiral pipe, fan, air pipe, combustion room, time limit relay, thermostat, and by-pass pipe in order to provide high efficiency, environmentally friendly, and automatic combustion of 10-18 mm nut-coal in solid, liquid, and gas fuel heating boilers.

In another application with No. TR2003/01675: the invention is formed of combustion device, burning tube, conic-shaped spiral, movable fuel valve, and movable slag crusher grits. Fuel valve and conic spirals are driven by an engine reducer and the movable grit and slag crusher system is driven by a hydraulic power source connected to cylinder piston mechanism. Grit and slag crushers are connected to a shaft passing through the beds placed near the tube. The flush valve is placed at the head part of the tube in a shape and position that it would flush the fuel found in the chamber above itself onto the spirals.

In the application with No. TR2009/07257: the invention relates to vertical push coal burning system, which can be applied in hot air boilers, heating boilers, high pressure steam boilers, and hot oil boilers, which can both combust coal and dust, and which implements efficient combustion as a result of mixing the coal during combustion via the pushing part found in the system.

BRIEF SUMMARY OF THE INVENTION

A purpose of the invention is to have different technical features than the prior art systems bringing a novel development in the field. The present system operates with 97% combustion efficiency. Moreover, it provides combustion of volatile gases originating from coal and obtaining energy from these gases.

A purpose of the invention is to provide combustion of 2000-7500 kkcall coal in sizes between 0-10 mm, 10-30 mm, and 30-50 mm and rate of moisture below 15%.

Another purpose of the invention is to have a system operating continuously and efficiently between 10-100% interval capacities with its original combustion structure. It responds to any possible capacity increase or decrease in the system easily with the same efficiency.

Another purpose of the invention is to produce this combustion system in larger and smaller sizes and capacities according to demand starting from domestic heating.

Another purpose of the invention is to provide an aerodynamic form with a circular burner, cylindrical combustion room, and dome-shaped roof. Also, the mechanical strength of the refractory material extends the operating life.

Another purpose of the invention is to minimize the energy losses by radiation, contact, and conventional ways with the refractory design.

Another purpose of the invention is to have a burner system providing homogeneous coal and air mixture on the entire surface.

Another purpose of the invention is to have special refractory cell providing combustion of volatile gases.

Another purpose of the invention is to eliminate the need for dust holding cyclone, recovery systems etc. additional equipments by recovering the gases via being combusted in the burner system, and thus not to bring additional cost.

Another purpose of the invention is to obtain optimum burning efficiency regulating stack gases and chimney temperature by continuously controlling the fuel and the oxygen.

Another purpose of the invention is to have a coal spreading system. Coal and air mixture is homogeneous. And this property is a factor of the burning efficiency.

Another purpose of the invention is to obtain an environmentally friendly system by achieving burning efficiency and minimizing particle ratio in the chimney.

Another purpose of the invention is to have an automatic slag crusher and discharge system as another advantage of the combustion system. In this way, its burning efficiency is maintained, provides endurance, does not require an operator, provides healthy and clean operating environment, and does not need halting due to slag and ash.

Another purpose of the invention is to minimize halting and failure by examining failure and maintenance points. Way of operation is simplified and operation software is developed using PLC. Since it is extremely easy to operate and operated by automation, operator error is eliminated. It provides continuous and optimum efficiency.

In order to achieve the above said purposes, the invention relates to solid fuel units comprising a fuel supply chamber wherein the fuel to be sent for combustion to the combustion region found in the body is placed and the feed mechanism carrying the solid fuel found in the said chamber forward. It comprises a main burning block having fuel/air cell connected to the said solid fuel supply chamber and air outlet vents formed on the external wall surface, a preventive surface positioned on the said main burning block external wall surface in a way that it would form a closed volume in a certain distance, at least one fuel discharge outlet providing sending of the fuel, which is transferred to the said main burning block cell, to the external wall surface, and at least one push component, which provides pushing of the solid fuel to the outlet hole via the spiral wings formed as facing each other, and which is connected on the same shaft in a way that it would make rotating motion.

REFERENCE NUMERALS

Figure 1:
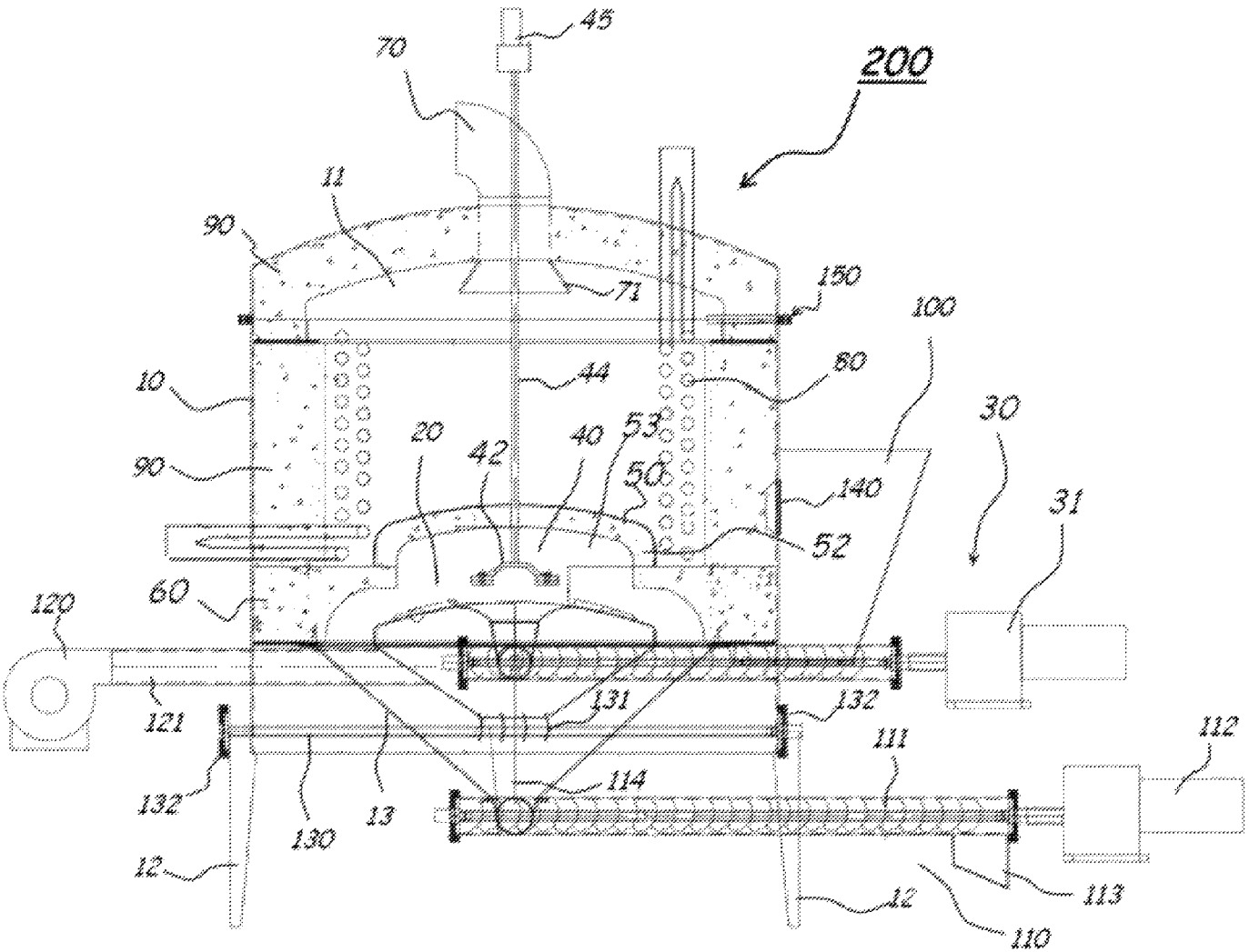
FIG. 1 is a sectional view showing all of the parts related to the solid fuel burning unit, which is the subject of the invention.

10 Body
11 Hot cell
12 Body feet
13 Ash removal line
20 Main burning block
21 Air outlet vents
22 Fuel and air cell
23 Fuel discharge outlet
24 Radiused surfaces
25 Cross partitions
26 Fuel inlet hole
27 Air inlet hole
28 External wall surface
29 Conic surface
29.1 Oval surfaces
30 Fuel feed mechanism
31 Drive component
32 Spiral wings
33 Inverse spiral wings
34 Push component
35 Shaft
40 Fuel spreader and mixer
41 Retaining surface
42 Mixer lever
43 Contact footings
44 Drive shaft
45 Drive component
50 Preventive surface
51 Impact surface
52 Positioning feet
53 Combustion cell

60 Loadbearing feet
70 Chimney outlet
71 Conic surfaces
80 Hot water pipes
90 Refractory insulation
100 Fuel supply chamber
110 Ash removal mechanism
111 Spiral of advance
112 Drive component
113 Conveyor outlet
114 Transfer duct
120 Air supply fan
121 Air transfer line

DETAILED DESCRIPTION OF THE INVENTION

In FIG. 1, the two-dimensional section view showing all of the parts related to the solid fuel burning unit, which is the subject of the invention, is given.

The invention relates to the solid fuel units (200) comprising a fuel supply chamber (100) wherein the fuel to be sent for combustion to the combustion region found in the body (10) is placed and the feed mechanism (30) carrying the solid fuel found in the said chamber (100) forward. It is characterized in that it comprises a main burning block (20) having a fuel and air cell (22) connected to the said solid fuel supply chamber (100) and air outlet vents (21) formed on the external wall surface (28), and a preventive surface (50) positioned on the said main burning block (20) external wall surface (28) in a way that it would form a closed volume in a certain distance.

Figure 2:
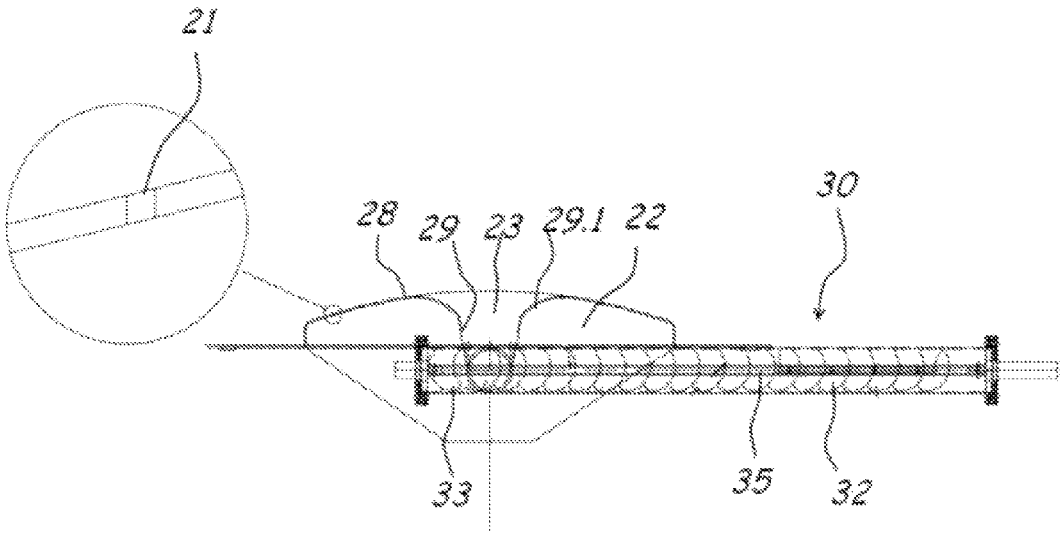
FIG. 2 is an isolated plan view of the main burning block and combustion cell, which is the subject of the invention.
Figure 3:
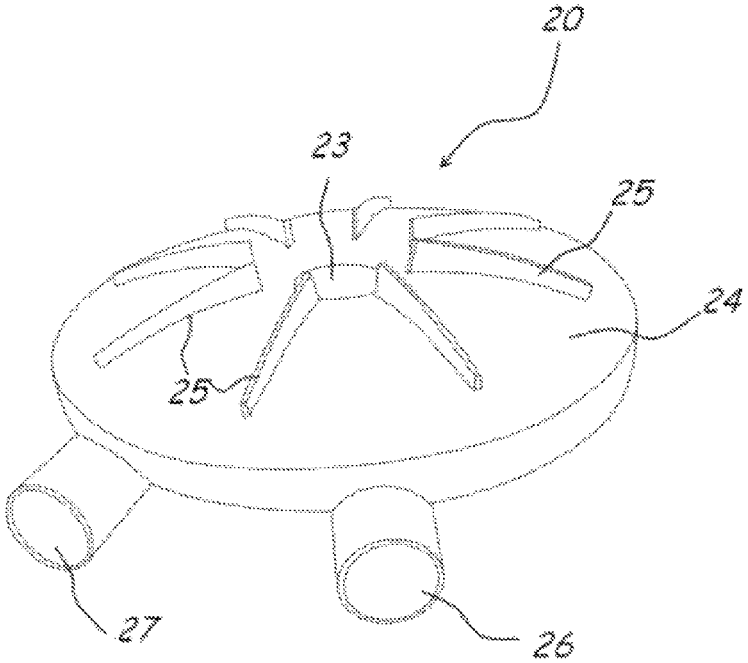
FIG. 3 is an isolated perspective view of the main burning block, in which the burning event occurs, and which plays effective role in burning volatile gases found in the fuel.

The invention comprises at least one fuel discharge outlet (23) providing sending of the fuel, which is transferred to the said main burning block (20) cell (22) as seen in FIG. 3, to the external wall surface (28) seen in FIG. 2, radiused surfaces (24) embodied on the said external wall surface (28), multiple cross partitions (25) formed on the said radiused surfaces (24) seen in FIG. 3, and fuel and air inlet holes (26,27) formed on the said main burning block (20).

Figure 5:
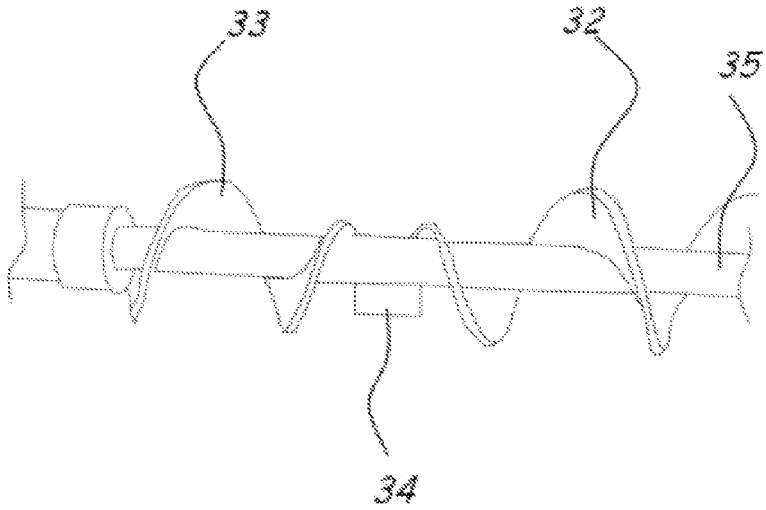
FIG. 5 is an isolated perspective view of the main burning block of the invention together with the preventive surface positioned on it.

The said fuel feed mechanism (30) seen in FIG. 2 comprises inverse spiral wings (33), which correspond to the spiral wings (32) formed on the shaft (35) seen in FIG. 5, and which are positioned on the same shaft (35), at least one push component (34), which provides pushing of the solid fuel to the outlet hole (23) via the spiral wings (32, 33) formed as facing each other, and which is connected on the same shaft (35) in a way that it would make rotating motion, and a drive component (31) providing rotating motion to the said spiral wings (32, 33) through shaft (35).

Figure 4:
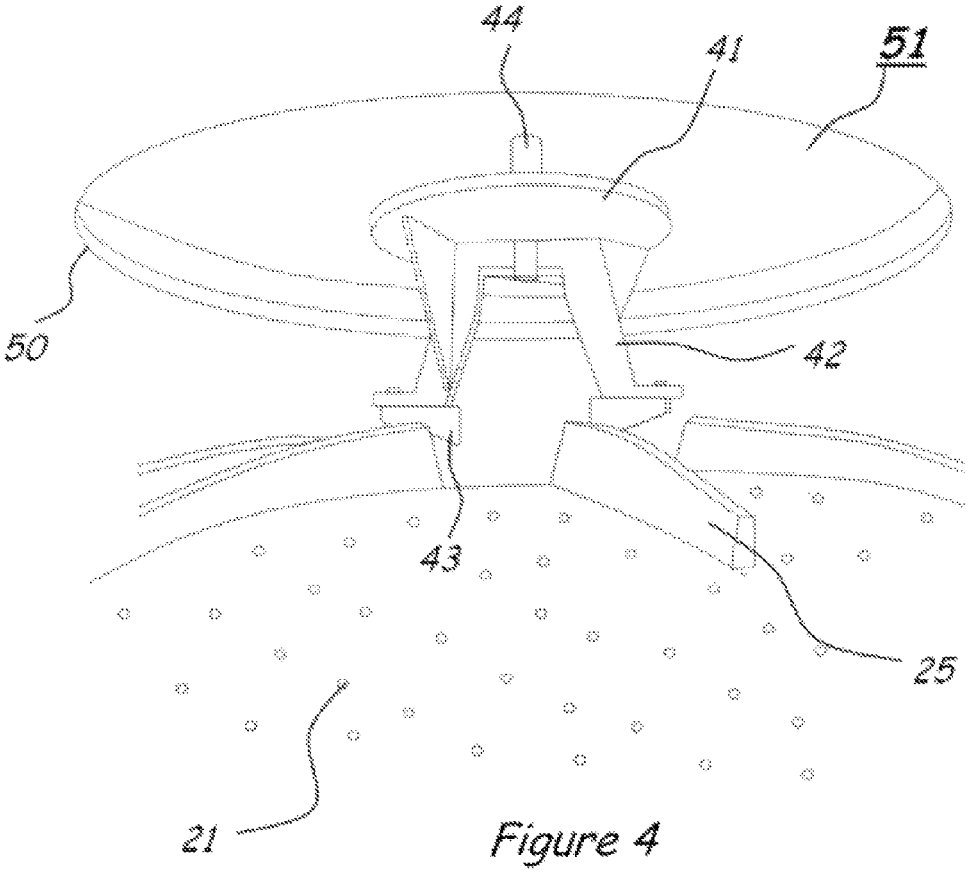
FIG. 4 is an isolated perspective view of the double effective spiral structure sending fuel to the main burning block used within the unit, which is the subject the invention, together with the flap.

The invention also comprises a fuel spreader and mixer (40) seen in FIG. 1 and providing homogeneous spreading of the fuel, which is pushed towards the said outlet hole (23) via push component (34), on the radiused surface (24), and the said fuel spreader and mixer (40) comprises a drive component (45) and drive shaft (44) making rotating motion via this drive component (45) and mixer lever (42) which is connected to the retaining surface (41) to which rotating motion is given via the motion transfer of the shaft (44), and it comprises contact footings (43), which are seen in FIG. 4, which are connected with the said mixer lever (42), and which homogeneously spread the solid fuel.

On the said preventive surface (50), the invention comprises an impact surface (51) seen in FIG. 4 preventing volatilization of volatile gases and positioning feet (52) forming an integral structure with this impact surface (51), and comprising load bearing feet (60), on which the said positioning feet (52) are positioned. Said load bearing feet (60) are made of refractory material.

The invention comprises a combustion cell (53) formed by positioning of the said positioning feet (52) on the load bearing feet (60), an air supply fan (120) having an air transfer line (121) providing external air support to the said main burning block (20) air inlet hole (27) and connected to this air inlet hole (27), an ash removal line (13) in connection with the body (10), to which the fuel ashes are transferred, and having a transfer duct (114), an ash removal mechanism (110) having a spiral of advance (111) and conveyor outlet (113) discharging the ashes coming from the said ash removal line (13), a drive component (112) providing rotating motion to the said spiral of advance (111), and a slag crusher component (130), which provides crushing of the slags falling in the said transfer line (13), and which is positioned in this line (13), and the said slag crusher component (130) comprises crusher wings (131) and bedding components (132).

The invention comprises at least one pressure gauge (150) positioned on the body (10) in order to gauge the pressure inside the said solid fuel unit (200) and comprises refractory insulation (90) positioned at the inner surface of the said body (10). A hot cell (11) surrounded by refractory insulation (90) and hot water and/or liquid pipes (80) positioned in this hot cell (11) are formed and also body feet (12) are formed at the body (10) lower region. The invention comprises chimney outlet (70) for discharging the stack gases formed in the hot cell (11), conic surfaces (71) formed at the region of this chimney outlet (70) extension facing the inside of the body (10), and viewing windows (140) again formed on the body (10) outer surface.

The operation system of the unit (200) is as follows: There is a metal body, in which all the structures are found, and which provides bearing of the unit. In order to enable intervention from below, the body (10) is found on feet (12).

Body (10) is cylindrical, while the roof is in a dome-form. Not to mention the fact that, the chimney is placed at the center of the dome. This aerodynamic form increases the burning performance. Integrity is given to the combustion cell with its burner shape. This form also provides mechanical strength for the refractory insulation (90).

There is a drive component (31) of the fuel feed mechanism (30) (drive component is an engine and reducer). Fuel is taken from the fuel supply chamber (100) with the help of the driven spiral wings (32). At the same time, air is given to the combustion cell (53) from the combustion block (20) air outlet vents (21) via the air supply fan (120). Solid fuel taken from the feed chamber (100) is transferred to the burner hole (23) via the spiral wings (32, 33). Counter-force is formed when the fuel encounters the inverse spiral wing (33) and it is transferred upwards, or in other words, towards the fuel discharge outlet (23) with the impact of the push component (34) operating on the spiral shaft. While the fuel moved by being compacted among the spirals (32, 33) goes towards the combustion surface, or in other words, towards the external wall surface (28), its volume expands while going through the oval surfaces (29.1) of the conic surface (29). With this expansion, heat transfer to the fuel is made quicker. This function provides heating of volatile gases found in the fuel while they go up to the burner radiused surfaces (24) and provide removal of the volatile gases found in the fuel. Feeding of the solid fuel from the burner centre provides homogeneous and uniform solid fuel exit to the combustion surface of the main burning block (20) radiused surface (24). Radiused surfaces (24) play an effective role in homogeneous and uniform spreading. Fuel spreader and mixer (40) provide homogeneous spreading of the fuel with volatile gases removed on the burner radiused surface (24).

From the air holes spread all around the burner surface in a certain system in accordance with its capacity, the air demanded by the burner is homogeneously transferred to the entire surface. This kind of spreading enables homogeneous combustion on the entire surface and increases efficiency. Volatile gases and combustible sulphur, which are removed from the structure, hit the preventive surface (50) made of refractory material while advancing in the burner hole and pass through the flame trap spread all over the surface and volatile gases are combusted in this way. Fuel fed on the burner continuously and in a controlled manner moves in accordance with the circular and swaged surface of the burner and proceeds by being combusted with the impact of the fuel spreader and mixer and air outlet vents (21) and the carbons found within it combust and turn into ash. The ashes and the slag are transferred to the ash removal mechanism (110) found below providing easy discharge of the ashes and the slags. In order to provide easy intake of the formed slag in pieces, herringbone cross partitions (25) are found on the radiused surface (24). Slags are manually interfered via combustion viewing and slag interference hole and thus they are sent to the conveyor outlet (113). While slag is poured into the chamber from the fuel, it is crushed in the crusher component (130) and removed from the unit (200) by being removed from the ash chamber via the spiral of advance (111).

I claim:

1. An apparatus for burning solid fuel comprising:

a body having an interior;

a solid fuel supply chamber connected to said body;

a feed mechanism extending between said solid fuel supply chamber and said interior of said body, said feed mechanism suitable for carrying the solid fuel from said solid fuel supply chamber toward a combustion region within said interior of said body;

a main burning block having an air and fuel cell connected to said solid fuel supply chamber, said main burning block having a plurality of air outlet vents formed on an external wall surface thereof;

a preventive surface positioned at a distance over said external wall surface of said main burning block so as to form a closed volume; and at least one fuel discharge outlet suitable for allowing the solid fuel to pass therethrough to said external wall surface of said main burning block, said external wall surface having radiused surfaces, the at least one fuel discharge outlet having conical surfaces and oval surfaces so as to provide for an expansion of the fuel, said external wall surface being circular and swaged;

a plurality of inverse spiral wings which correspond to a plurality of spiral wings formed on a shaft of said feed mechanism so as to face each other;

at least one push component suitable for pushing the solid fuel toward the fuel discharge outlet via said plurality of spiral wings and said plurality of inverse spiral wings, said shaft causing said plurality of spiral wings and said plurality of inverse spiral wings to rotate;

a fuel spreader and mixer comprising a drive component and a drive shaft and a mixer lever, said drive shaft and said drive component causing a rotating motion of said mixer lever so as to cause homogenous spreading of the fuel on said radiused surfaces after said push component pushes the solid fuel toward said fuel discharge outlet;

a plurality of contact footings connected to said mixer lever so as to homogenously spread the solid fuel;

an impact surface formed on said preventive surface so as to prevent volatilization of volatile gases;

a plurality of positioning feet formed integrally with said impact surface;

a plurality of load-bearing feet upon which said plurality of positioning feet are positioned; and a combustion cell formed by the positioning of said plurality of positioning feet upon said plurality of load-bearing feet, said radiused surfaces having multiple cross partitions formed therein.

2. The apparatus of claim 1, said main burning block having fuel and air holes formed thereon.

3. The apparatus of claim 1, said load-bearing feet formed of a refractory material.

4. The apparatus of claim 2, further comprising:

an air supply fan having an air transfer line connected to said air inlet hole so as to provide an external air supply to said air inlet hole.

5. The apparatus of claim 1, further comprising:

an ash removal line connected to said interior of said body so as to transfer fuel ashes therefrom.

6. The apparatus of claim 5, further comprising:

an ash removal mechanism having a spiral conveyor and a conveyor outlet so as to discharge fuel ashes from said ash removal line.

7. The apparatus of claim 6, further comprising:

a drive component driving connected to said spiral conveyor so as to provide rotation to said spiral conveyor.

8. The apparatus of claim 5, further comprising:

a slag crusher component positioned in said ash removal line so as to crush slag falling through said ash removal line.

9. The apparatus of claim 8, said slag crusher component having crusher wings and bedding components.

10. The apparatus of claim 1, further comprising:

at least one pressure gauge positioned on said body so as to measure a pressure within said interior of said body.

11. The apparatus of claim 1, further comprising:

a refractory insulation material positioned at an inner surface of said body.

* * * * *